US006554518B1

(12) United States Patent
Pei

(10) Patent No.: US 6,554,518 B1
(45) Date of Patent: Apr. 29, 2003

(54) WRITING INSTRUMENT WITH A RETRACTION DEVICE

(76) Inventor: Yu-Chen Pei, 1F, No. 56, Sec. 2, Yung-An N. Rd., Luchou City, Taipei Hsien (TW)

( * ) Notice: Subject to any disclaimer, the term of this patent is extended or adjusted under 35 U.S.C. 154(b) by 0 days.

(21) Appl. No.: 10/158,893

(22) Filed: Jun. 3, 2002

(51) Int. Cl.[7] ..... B43K 5/16
(52) U.S. Cl. ..... 401/112; 401/110; 401/111
(58) Field of Search ..... 401/112, 103, 401/109, 110, 111, 113, 114

(56) References Cited

U.S. PATENT DOCUMENTS 4,381,158 A * 4/1983 Garganese ..... 401/111
4,943,175 A * 7/1990 Heim ..... 401/112
5,413,428 A * 5/1995 Kageyama ..... 401/111
6,257,787 B1 * 7/2001 Kirk ..... 401/111

* cited by examiner

*Primary Examiner*—David J. Walczak
(74) *Attorney, Agent, or Firm*—Jones, Tullar & Cooper, P.C.

(57) ABSTRACT

A writing instrument with a retraction device includes a hollow barrel, a grip attached to a lower end of the hollow barrel, a writing implement mounted in the hollow barrel and the grip, and an elastic member mounted around a lower portion of the writing implement. The grip has a rigid sleeve mounted in a lower end of the grip opposite to the hollow barrel. The writing implement has a writing tip formed on a lower end of the writing implement, which selectively extends through the rigid sleeve in the grip. The elastic member abuts the rigid sleeve and is driven by the rigid sleeve. The user only needs to press the writing tip or the rigid sleeve to retract or extend the writing tip.

3 Claims, 6 Drawing Sheets

WRITING INSTRUMENT WITH A RETRACTION DEVICE

BACKGROUND OF THE INVENTION

1. Field of the Invention

The present invention relates to a writing instrument, and more particularly to a writing instrument with a retraction device.

2. Description of Related Art

A writing instrument is an important tool used to write, record things or draw. Generally speaking, a conventional writing instrument comprises a hollow barrel, a writing implement and a cap. The writing implement is mounted in the hollow barrel and has a writing tip extending out of the hollow barrel. The cap is detachably mounted on one end of the hollow barrel to keep the writing tip of the writing implement from being damaged. However, the cap of the writing instrument is easily lost. Consequently, a writing instrument with a retraction device is manufactured and marketed.

The conventional writing instrument with a retraction device can make the writing tip of the writing implement draw back into the hollow barrel such that a cap is unnecessary. However, a button to operate the retraction device is usually located on the top of the hollow barrel. This location is inconvenient for a person whose fingers are handicapped.

The present invention has arisen to mitigate and/or obviate the disadvantages of the two conventional writing instruments.

SUMMARY OF THE INVENTION

The main objective of the present invention is to provide an improved writing instrument with a retraction device.

To achieve the objective, the writing; instrument with a retraction device in accordance with the present invention comprises a hollow barrel, a tubular grip, a writing implement and an elastic member. The hollow barrel has an upper end and a lower end. The grip is attached to the lower end of the hollow barrel. The writing implement is mounted in the hollow barrel and the grip and has an upper portion, a lower portion, an upper end, a lower end and a writing tip. The elastic member is mounted around the lower portion of the writing implement. The grip has an upper end and a lower end. A rigid sleeve is mounted in the lower end of the grip. The writing tip is formed on the lower end of the writing implement and selectively extending through the rigid sleeve in the grip. The elastic member abuts the rigid sleeve and is compressed by the rigid sleeve.

Further benefits and advantages of the present invention will become apparent after a careful reading of the detailed description with appropriate reference to the accompanying drawings.

DETAILED DESCRIPTION OF THE INVENTION

Figure 1:
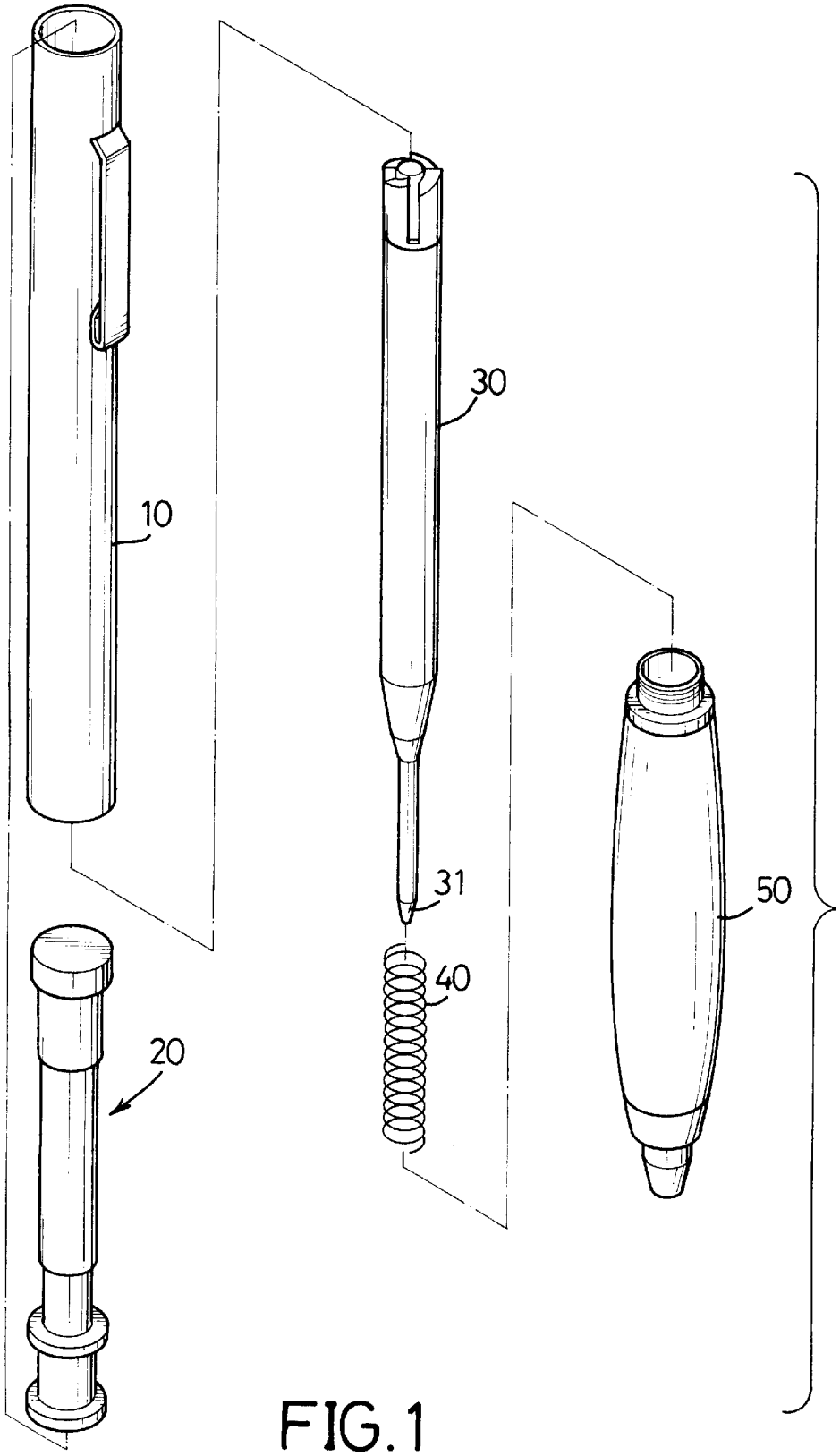
FIG. 1 is an exploded perspective view of a writing instrument with a retraction device in accordance with the present invention.
Figure 2:
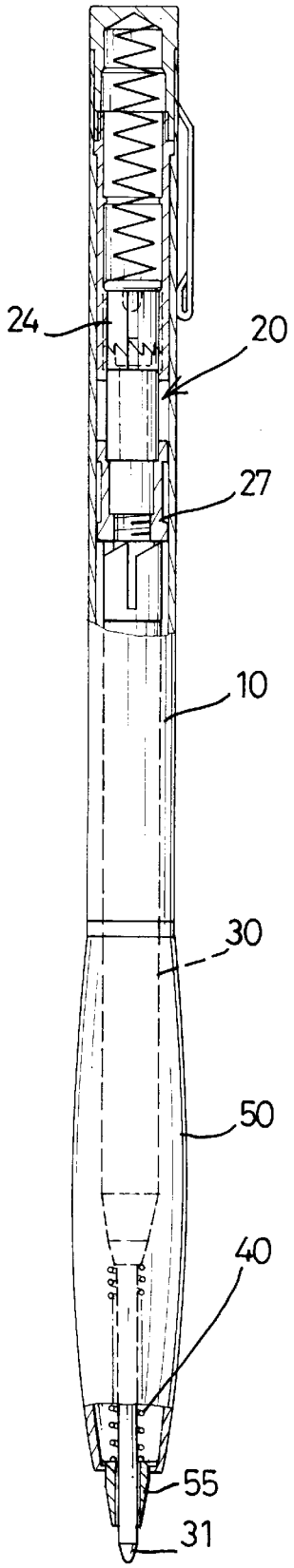
FIG. 2 is a side plan view in partial cross section of the writing instrument in FIG. 1.

With reference to the drawings and initially to FIGS. 1 and 2, a writing instrument with a retraction device in accordance with the present invention comprises a hollow barrel (10), a tubular grip (50), a writing implement (30), an elastic member (40) and a retraction device (20). The hollow barrel (10) has an upper end and a lower end. The tubular grip (50) has an upper end and a lower end, and the upper end is attached to the lower end of the hollow barrel (10). The writing implement (30) has an upper portion, a lower portion, an upper end and a lower end and is mounted in the hollow barrel (10) and the grip (50). The lower portion of the writing implement (30) has a smaller diameter than the upper portion. A rigid sleeve (55) is mounted in the lower end of the grip (50). A writing tip (31) is formed on the lower end of the writing implement (30) and selectively extends through the rigid sleeve (55) in the grip (50). In the preferred embodiment of the present invention, the elastic member (40) is a spring. The elastic member (40) is mounted around the lower portion of the writing implement (30) between the rigid sleeve (55) and the upper portion of the writing implement (30). The elastic member (40) is compressed by the rigid sleeve (55).

Figure 3:
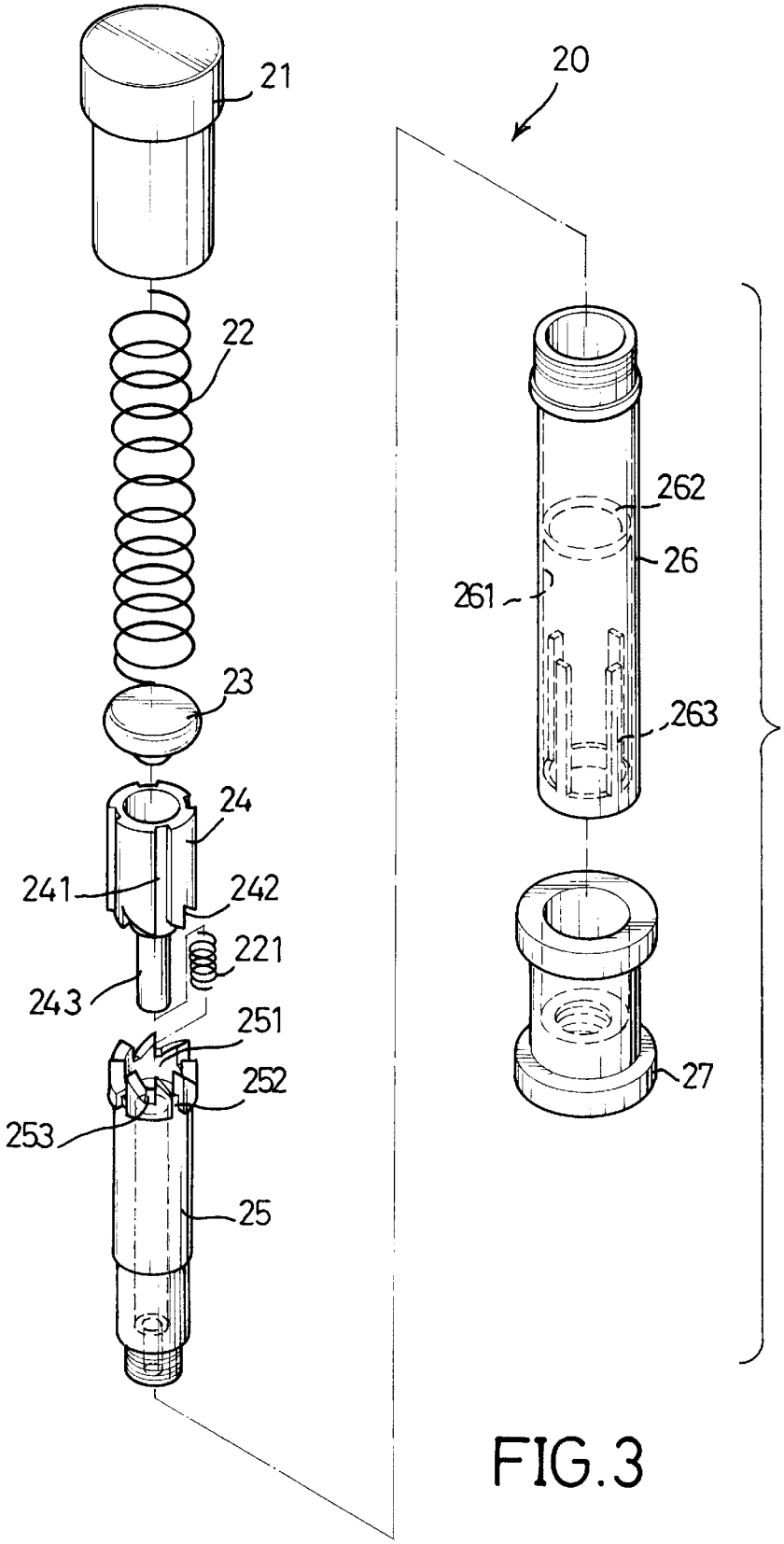
FIG. 3 is an exploded perspective view of the retraction device in FIG. 2.
Figure 4:
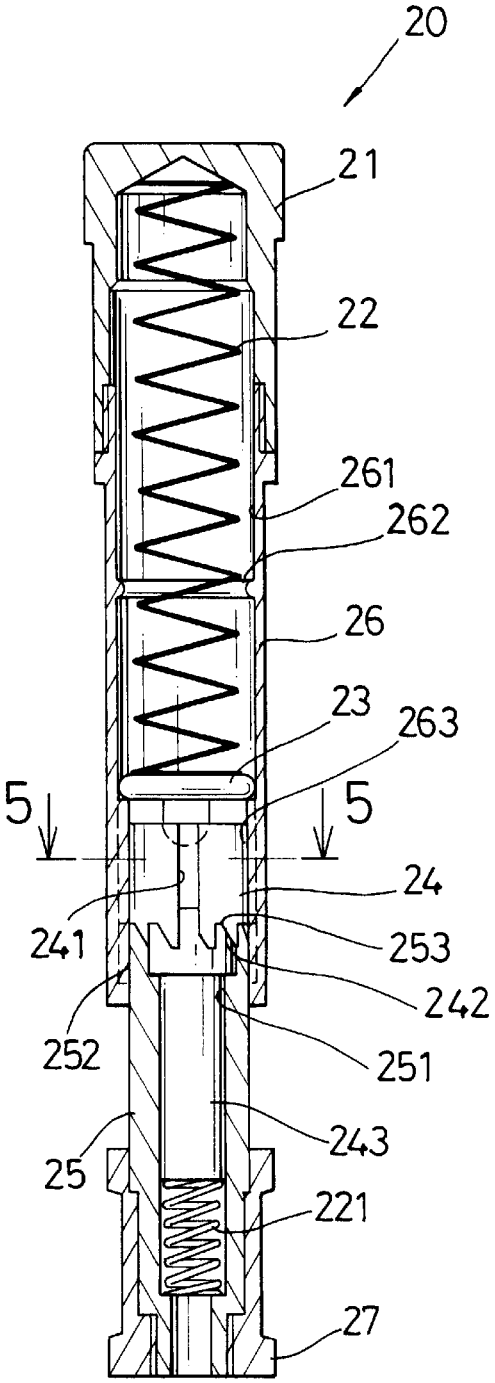
FIG. 4 is a cross sectional side plan view of the retraction device in FIG. 3.
Figure 5:
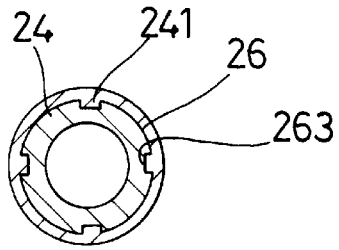
FIG. 5 is a cross sectional top plan view of the retraction device in FIG. 4 along line 5—5.

With further reference to FIGS. 3, 4 and 5, the retraction device (20) comprises a tubular body (26), a pawl shaft (25), a ratchet (24), a plug (23), a lower cap (27), a barrel cap (21) and a main spring (22). The tubular body (26) has a top end and a lower end. A through hole (261) is longitudinally defined in the tubular body (26) such that the tubular body (26) has an inner surface and an outer surface. An annular rib (262) is formed on inner surface of the tubular body (26). Multiple longitudinal keys (263) are formed on and radially extend in from the inner surface of the tubular body (26) near the lower end of the tubular body (26).

The pawl shaft (25) has an upper end and a lower end. The upper end is movably mounted in the through hole (261) in the tubular body (26). A hole (251) with an internal shoulder (not numbered) is axially defined in the pawl shaft (25) and communicates with the through hole (261) in the tubular body (26). The pawl shaft (25) has an outer surface and an inner surface. Multiple keyways (252) are longitudinally defined in the outer surface of the upper end of the pawl shaft (25) to slidably hold the keys (263) to prevent the pawl shaft (25) from rotating. A ring of pawl teeth (253) form a circular pawl on the upper end of the pawl shaft (25). Two pawl teeth (253) are formed between adjacent keyways (252).

A ratchet (24) is movably mounted in the through hole (261) in the tubular body (26). The ratchet (24) has an upper end, a lower end, an outer surface and a coaxial shaft (243) extending from the lower end of the ratchet (24). The coaxial shaft (243) is slidably and rotatably mounted in the hole (251) in the pawl shaft (25). A ratchet spring (221) is compressively mounted in the hole (251) in the pawl shaft (25) between the shaft (243) and the shoulder in the hole (251) in the pawl shaft (25). Multiple keyways (241) are longitudinally defined in the outer surface of the ratchet (24)

to selectively receive the keys (263) in the tubular body (26). Ratchet teeth (242) are formed on the lower end of the ratchet (24) at the junction with the coaxial shaft (243). Two ratchet teeth (242) are formed between adjacent keyways (241) on the ratchet (24). The ratchet teeth (242) on the ratchet (24) selectively correspond and engage the pawl teeth (253) on the pawl shaft (25). The plug (23) is movably mounted in the through hole (261) in the tubular body (26) and abuts the upper end of the ratchet (24). The lower cap (27) is attached to the lower end of the pawl shaft (25) and abuts the upper end of the writing implement (30). The barrel cap (21) is securely pressed into the upper end of the hollow barrel (10) and is securely attached to the tubular body (26) to hold the retraction device (20) in place in the hollow barrel (10). The main spring (22) is compressively mounted in the through hole (261) in the tubular body (26), between the barrel cap (21) and the plug (23).

Figure 6:
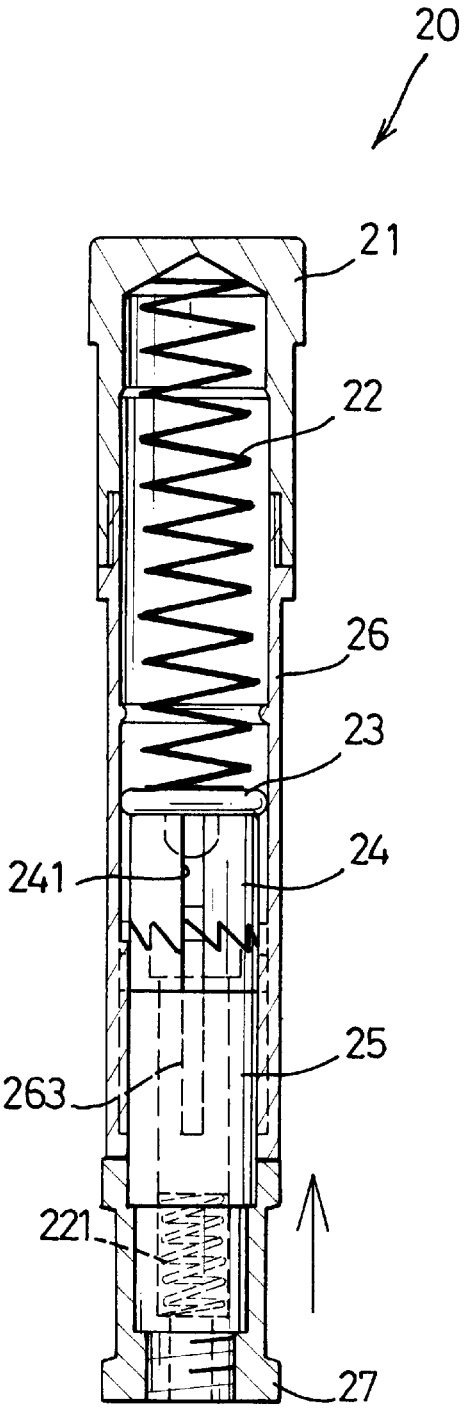
FIG. 6 is an operational cross sectional side plan view of the retraction device in FIG. 4.
Figure 7:
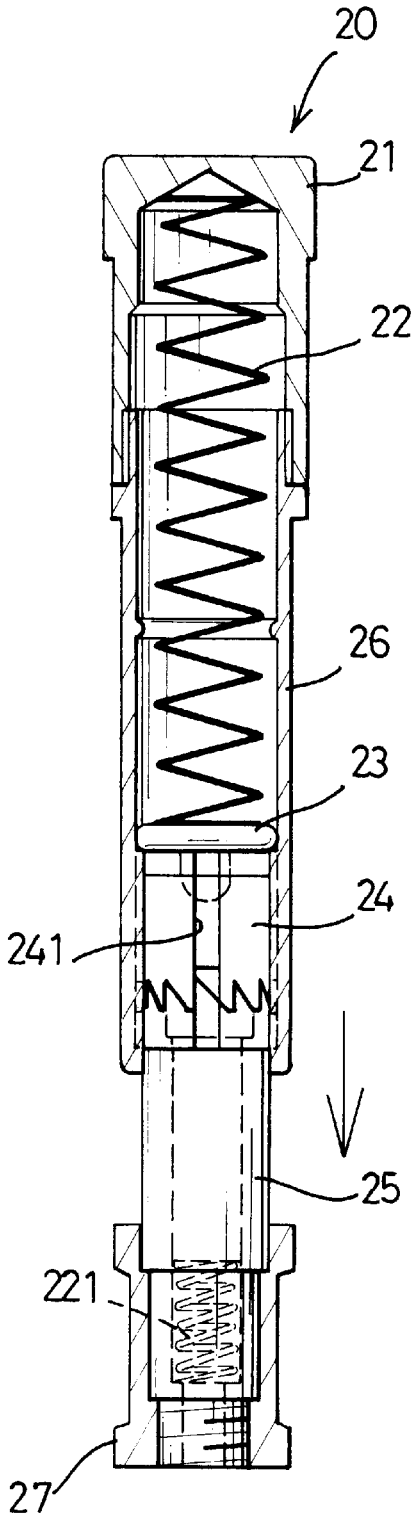
FIG. 7 is an operational cross sectional side plan view of the retraction device in FIG. 4.
Figure 8:
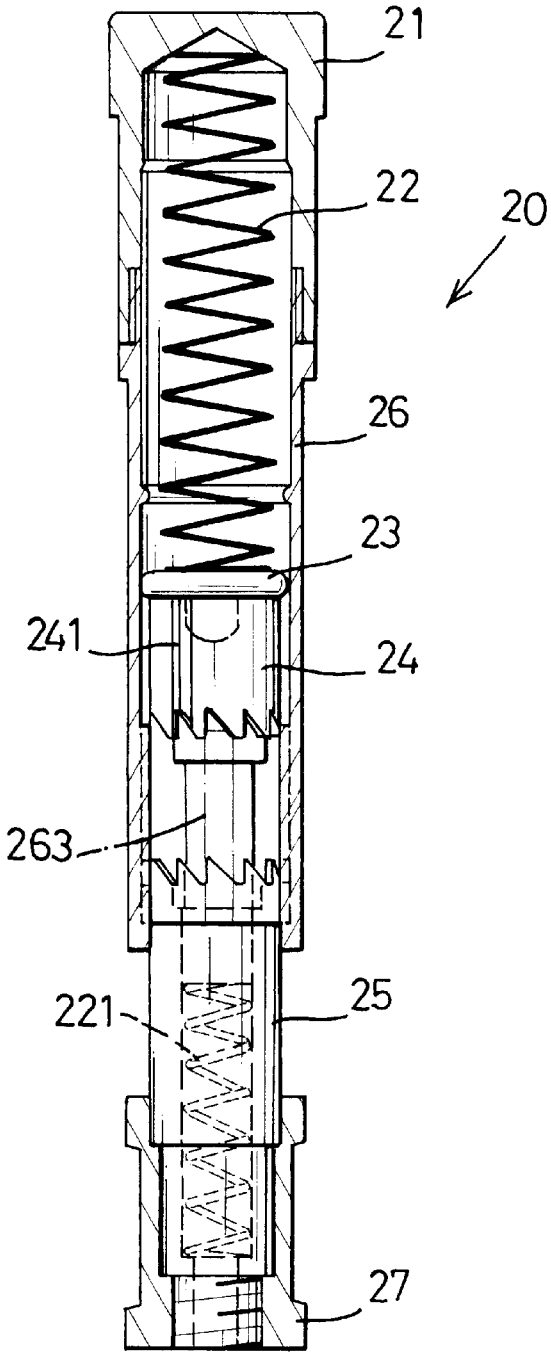
FIG. 8 is an operational cross sectional side plan view of the retraction device in FIG. 4.

With reference to FIGS. 4 and 6, the retraction device is operated by moving the pawl shaft (25) and the ratchet (24) upward along the longitudinal keys (263) when the lower cap (27) is moved upward to push the pawl shaft (25). The ratchet (24) is rotated to an adjacent pawl tooth (253) when the ratchet (24) detaches from the longitudinal keys (263) due to inclined sides of the ratchet teeth (242) and pawl teeth (253) of the ratchet (24) and the pawl shaft (25), respectively. With reference to FIGS. 7 and 8, the main spring (22) pushes the plug (23) and the ratchet (24) downward when the pushing force on the lower cap (27) is released. The ratchet (24) cannot move back to the original position because the ratchet (24) is rotated to a pitch of the two ratchet teeth (242) and the keyways (241) of the ratchet (24) do not align with the longitudinal keys (263) in the tubular body (26). However, the pawl shaft (25) is moved upward to abut the ratchet (24) due to a retraction force generated by the ratchet spring (221) so that the teeth (242, 253) on the ratchet (24) and the pawl shaft (25) are always engaged to each other.

With reference to FIGS. 1 and 2, the lower cap (27) is pushed upward by the top of the writing implement (30) when the writing tip (31) of the writing implement (30) is pressed. The writing implement (30) is fully retracted into the hollow barrel (10) and the grip (50) due to the restitution force of the resilient member (40) when the pushing force of the writing implement (30) disappears. On the contrary, the ratchet (24) is rotated again when the user presses the rigid sleeve (55) to push the writing tip (31) upward with his fingertips. Then the keyways (241) align with the longitudinal keys (263) again so the main spring (22) pushes the retraction device (20) to the original position and makes the writing end (31) extend through the grip (50) so a user can write or draw.

As described, the retraction device in accordance with the present invention is easily operated. The user only needs to press the writing tip (31) or the rigid sleeve (55) to extend or retract the writing tip (31). The design of the writing instrument is convenient for a person whose fingers are handicapped.

Although the invention has been explained in relation to its preferred embodiment, it is to be understood that many other possible modifications and variations can be made without departing from the spirit and scope of the invention as hereinafter claimed.

What is claimed is:

1. A writing instrument with a retraction device comprising:

a hollow barrel with an upper end, a lower end, an inside surface and an outside surface;

a grip with an upper end and a lower end attached to the lower end of the hollow barrel, the grip having a rigid sleeve mounted in the lower end of the grip;

a writing implement with an upper end, a lower end, an upper portion and a lower portion with a smaller diameter than the upper portion mounted in the hollow barrel and the grip, the writing implement having a writing tip formed on the lower end of the writing implement and selectively extending through the rigid sleeve in the grip;

an elastic member mounted around the lower portion of the writing implement between the upper portion of the writing implement and the rigid sleeve and compressed by the rigid sleeve; and a retraction device comprising:

a tubular body with an upper end and a lower end having a through hole longitudinally defined through the tubular body such that the tubular body has an inner surface and an outer surface, an annular rib formed on the inner surface, and multiple longitudinal keys formed on the inner surface of the through hole near the lower end of the tubular body;

a pawl shaft with an upper end, a lower end and an outer surface having the upper end movably mounted in the through hole in the tubular body, a hole with a shoulder centrally defined in the pawl shaft and communicating with the through hole in the tubular body, multiple keyways longitudinally defined in the outer surface of the upper end of the pawl shaft to slidably hold the keys to prevent the pawl shaft from rotating, and pawl teeth formed on the upper end of the pawl shaft where two pawl teeth are between adjacent keyways;

a ratchet with an upper end, a lower end and an outer surface movably mounted in the through hole, the ratchet having a shaft extending from the lower end and received in the hole in the pawl shaft, a ratchet spring compressively mounted in the hole between the shaft and the shoulder in the hole, multiple keyways longitudinally defined in the outer surface of the ratchet to selectively receive the keys of the tubular body, and ratchet teeth are formed on the lower end of the ratchet at the junction with the shaft, wherein there are two of the ratchet teeth formed between adjacent keyways of the ratchet, the ratchet teeth of the ratchet selectively correspond and engage the pawl teeth on the pawl shaft;

a lower cap attached to the lower end of the pawl shaft to abut the upper end of the writing implement;

a barrel cap pressed into the hollow barrel and attached to the tubular body to hold the retraction device in place in the hollow barrel; and a main spring compressively mounted in the through hole in the tubular body between the barrel cap and the ratchet.

2. The writing instrument with a retraction device as claimed in claim 1, wherein the retraction device further comprises a plug movably mounted in the through hole in the tubular body and between the main spring and the ratchet.

3. The writing instrument with a retraction device as claimed in claim 1, wherein the elastic member is a spring.

* * * * *